US008999475B2

(12) United States Patent
Mitsuhashi

(10) Patent No.: US 8,999,475 B2
(45) Date of Patent: Apr. 7, 2015

(54) COMPONENT OF SUBSTRATE PROCESSING APPARATUS AND METHOD FOR FORMING A FILM THEREON

(75) Inventor: Koji Mitsuhashi, Nirasaki (JP)

(73) Assignee: Tokyo Electron Limited, Tokyo (JP)

( * ) Notice: Subject to any disclaimer, the term of this patent is extended or adjusted under 35 U.S.C. 154(b) by 804 days.

(21) Appl. No.: 12/355,210

(22) Filed: Jan. 16, 2009

(65) Prior Publication Data

US 2009/0186184 A1 Jul. 23, 2009

Related U.S. Application Data

(60) Provisional application No. 61/048,377, filed on Apr. 28, 2008.

(30) Foreign Application Priority Data

Jan. 22, 2008 (JP) ..... 2008-011372

(51) Int. Cl.

| | |
|---|---|
| ***B32B 3/02*** | (2006.01) |
| ***C25D 5/00*** | (2006.01) |
| ***H01L 21/31*** | (2006.01) |
| ***C25D 21/02*** | (2006.01) |
| ***C25D 11/24*** | (2006.01) |
| ***C25D 11/00*** | (2006.01) |

(52) U.S. Cl.
CPC ..... *C25D 21/02* (2013.01); *C25D 11/246* (2013.01); *C25D 11/005* (2013.01)

(58) Field of Classification Search
USPC ..... 428/66.6, 46; 205/235; 438/765
See application file for complete search history.

(56) References Cited

U.S. PATENT DOCUMENTS

| | | | | |
|---|---|---|---|---|
| 6,110,287 | A | 8/2000 | Arai et al. | |
| 6,700,089 | B1 * | 3/2004 | Hirooka | 219/121.4 |
| 2006/0189168 | A1 * | 8/2006 | Sato et al. | 438/795 |

FOREIGN PATENT DOCUMENTS

| | | | | |
|---|---|---|---|---|
| JP | 6-316787 | A | 11/1994 | |
| JP | 9-31099 | | 2/1997 | |
| JP | 11229185 | A * | 8/1999 | C25D 11/04 |
| JP | 2002-212787 | | 7/2002 | |
| JP | 2007-204831 | | 8/2007 | |
| KR | 10-0324792 | B1 | 6/2002 | |

OTHER PUBLICATIONS

Translation of Hashimoto (JP 2002-212787).*
Korean Office Action issued Mar. 4, 2011, in Patent Application No. 10-2009-0004663 (with English-language translation).
F. Cverna, "Worldwide guide to equivalent nonferrous metals and alloys", ASM International, 4th edition, Dec. 2001, 3 pages.

* cited by examiner

*Primary Examiner* — Gwen Blackwell
*Assistant Examiner* — Anthony J Frost
(74) *Attorney, Agent, or Firm* — Rothwell,Figg, Ernst & Manbeck, P.C.

(57) ABSTRACT

A component of a substrate processing apparatus that performs plasma processing on a substrate includes a base mainly formed of an aluminum alloy containing silicon. A film is formed on the surface of the base by an anodic oxidation process which includes connecting the component to an anode of a power supply and immersing the component in a solution mainly formed of an organic acid. The film is impregnated with ethyl silicate.

20 Claims, 6 Drawing Sheets

COMPONENT OF SUBSTRATE PROCESSING APPARATUS AND METHOD FOR FORMING A FILM THEREON

FIELD OF THE INVENTION

The present invention relates to a component of a substrate processing apparatus and a method for forming a film thereon, and more particularly to a component of a substrate processing apparatus that performs plasma processing on a substrate and a method for forming a film thereon.

BACKGROUND OF THE INVENTION

As substrate processing apparatuses for performing a predetermined processing on a wafer as a substrate, a film forming apparatus that performs film formation processing by CVD (chemical vapor deposition) or PVD (physical vapor deposition) and an etching apparatus that performs etching processing are known. In recent years, the substrate processing apparatus has increased in size with the increase in the diameter of wafer and, therefore, the increase in the weight of the substrate processing apparatus has become an issue to be concerned about. Thus, a lightweight aluminum member has been widely used as a material of components of the substrate processing apparatuses.

Generally, since an aluminum member has a low corrosion resistance to a corrosion gas or a plasma that is used for specific processing in the substrate processing apparatus, an alumite film having a corrosion resistance is formed on the surfaces of components made of the aluminum members, for example, a cooling plate (see, for example, Japanese Patent Laid-open Application No. 2007-204831). Moreover, the formed alumite film has pores and is generally subjected to a sealing process for sealing the pores.

However, there have been cases in which a high power plasma processing, typically represented by HRAC (high aspect ratio contact) processing and the like, is performed on wafers. In the high power plasma processing, the temperature of a cooling plate rises, but a sealed alumite film generally has a low heat resistance. For this reason, in the plasma processing, damages such as cracks develop in the alumite film formed on the cooling plate, and the alumite film is partially peeled off to generate particles. To solve the above problems, the present inventor conceived an alumite film forming method, in which an alumite film is semi-sealed, whereby the heat resistance of the alumite film is improved (see, for example, Japanese Patent Laid-open Application No. 2008-81815).

Recently, much higher power plasma processing has been under consideration. Therefore, even though the alumite film is formed in accordance with the above-described alumite film forming method, the alumite film has an insufficient heat resistance, and the alumite film can be damaged, thereby generating particles.

Further, a cooling plate having the alumite film formed thereon requires a process for forming thereon a circuit for supplying radio frequency power. However, cutting oil or hydrocarbon-based cleaning fluid which is used in the processing infiltrates into the alumite film, so that the hydration sealing of the alumite film is promoted. If the hydration sealing is promoted, the heat resistance of the alumite film can be deteriorated, and thus the alumite film can be damaged to thereby generate particles.

SUMMARY OF THE INVENTION

The present invention provides a component for a substrate processing apparatus and a film forming method, in which the generation of particles due to a damage of an alumite film can be reliably prevented.

In accordance with a first aspect of the present invention, there is provided a component of a substrate processing apparatus that performs plasma processing on a substrate. The component includes a base mainly formed of an aluminum alloy containing silicon; and a film formed on the surface of the base by an anodic oxidation process which includes connecting the component to an anode of a power supply and immersing the component in a solution mainly formed of an organic acid, the film being impregnated with ethyl silicate.

If the substrate is connected to the anode of a power supply and immersed in a solution mainly formed of an organic acid, an oxide film grows mainly inward from the surface of the base, while the amount of an oxide film growing outward from the surface of the base is small. That is, the amount of oxide crystal columns growing outward from the surface is small, and thus the development of compressive stress caused by the collision between the crystal columns can be greatly suppressed.

Further, the crystal columns of oxide grow radially from the silicon of the base as a nucleus, and thus the crystal structure of the film is not aligned one, so that the heat resistance of the film is improved. Moreover, since ethyl silicate is impregnated into the film, the silicon of ethyl silicate is dispersed into the film to remain as silicon granules, and the infiltration of cutting oil or the like into the film is prevented. Accordingly, hydration sealing of the film is suppressed, and the heat resistance of the film is ensured. As a result, even when the component for the substrate processing apparatus is heated to a high temperature or comes in contact with cutting oil or the like, the generation of particles due to a damage of the film can be reliably prevented.

In accordance with a second aspect of the present invention, there is provided a component of a substrate processing apparatus that performs plasma processing on a substrate. The component includes a base mainly formed of an aluminum alloy containing silicon; and a film disposed on the surface of the substrate and having oxide crystal columns oriented radially from the silicon as a nucleus, the film being impregnated with ethyl silicate.

If the oxide crystal columns are oriented radially from the silicon as a nucleus, the structure of the film is not aligned one, so that the heat resistance of the film is improved. Also, since ethyl silicate is impregnated into the film, the silicon of ethyl silicate is dispersed in the film to remain as silicon granules, and the infiltration of cutting oil or the like into the film is prevented. Thus, hydration sealing of the film is suppressed, and the heat resistance of the film is ensured. Accordingly, even when the component is heated to a high temperature or comes in contact with cutting oil or the like, the generation of particles due to a damage of the film can be reliably prevented.

The film may be not subjected to sealing treatment.

A plurality of pores are formed in the film, but when the pores are subjected to sealing treatment, e.g., hydration sealing treatment, compressive stress develops in each of the pores, because a place for discharging oxide cannot be ensured in each pore, when the oxide expands in each pore. Since the film is not subjected to sealing treatment, any development of the compressive stress can be prevented. Accordingly, even when the component is heated to a high temperature, the generation of particles due to a damage of the film can be more reliably prevented.

An amount of the silicon contained in the alloy is preferably in a range from 0.4 to 0.8 mass %.

Thus, a numerous number of oxide crystal columns growing radially from the silicon as a nucleus can be generated, and high heat resistance of the film can be ensured.

The alloy may be a JIS A6061 alloy. Thus, the above-described effects can be remarkably obtained.

The component may be an upper electrode.

The film is formed on the surface of the upper electrode base mainly formed of a silicon-containing aluminum alloy by bringing an organic acid into contact with the surface, and the film is impregnated with ethyl silicate. Thus, the generation of particles due to a damage of the film on the upper electrode can be reliably prevented.

The component may be a disk-shaped cooling plate which has a plurality of through holes.

The film is formed on the cooling plate base mainly formed of a silicon-containing aluminum alloy and in each of the through holes by bringing an organic acid into contact with the base, and the film is impregnated with ethyl silicate. Thus, the generation of particles due to a damage of the cooling plate can be reliably prevented.

In accordance with a third aspect of the present invention, there is provided a film forming method wherein the film is formed on a component of a substrate processing apparatus that performs plasma processing on a substrate.

The method includes an anodic oxidizing of connecting the component having a base mainly formed of a silicon-containing aluminum alloy to an anode of a power supply and immersing the component in a solution mainly formed of an organic acid; and an impregnating of impregnating ethyl silicate into a film formed on the surface of the base by the immersing.

If the base is connected to the anode of a power supply and immersed in a solution mainly formed of an organic acid, an oxide film grows inward from the surface of the substrate, whereas the amount of an oxide film growing outward from the surface of the substrate is small. That is, since the amount of oxide crystal columns growing outward from the surface is small, the development of compressive stress by the collision between the crystal columns can be greatly suppressed.

Further, the crystal columns of oxide grow radially from the silicon of the base as a nucleus, and thus the crystal structure of the film is not aligned one, so that the heat resistance of the film is improved. Moreover, since ethyl silicate is impregnated into the film, the silicon of ethyl silicate is dispersed into the film to remain as silicon granules, and the infiltration of cutting oil or the like into the film is prevented. Accordingly, hydration sealing of the film is suppressed, and the heat resistance of the film is ensured. As a result, even when the component for the substrate processing apparatus is heated to a high temperature or comes in contact with cutting oil or the like, the generation of particles due to a breakage of the film can be reliably prevented.

BRIEF DESCRIPTION OF THE DRAWINGS

The objects and features of the present invention will become apparent from the following description of embodiments, given in conjunction with the accompanying drawings, in which.

DETAILED DESCRIPTION OF THE EMBODIMENTS

Hereinafter, an embodiment of the present invention will be described with reference to the accompanying drawings which form a part hereof.

First, a description will be made on a substrate processing apparatus to which a component of a substrate processing apparatus in accordance with the embodiment of the present invention is applied.

Figure 1:
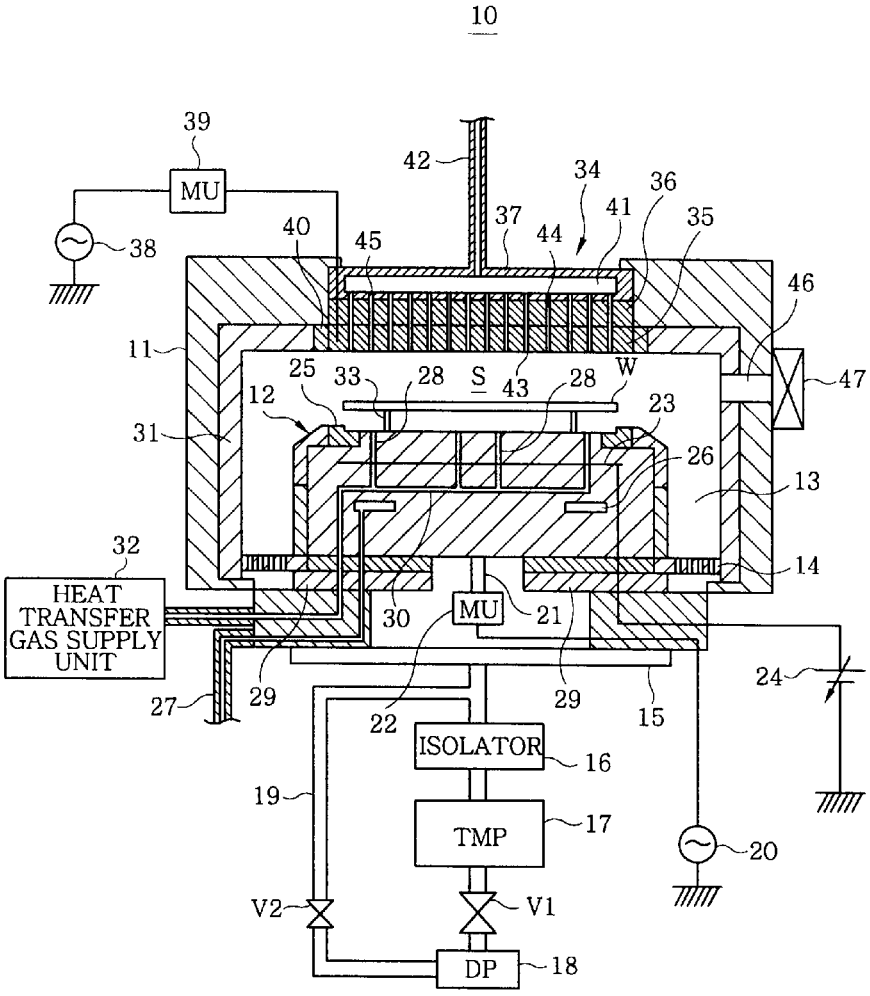
FIG. 1 is a cross-sectional view schematically showing a configuration of a substrate processing apparatus to which a component of a substrate processing apparatus in accordance with an embodiment of the present invention is applied.

FIG. 1 is a cross-sectional view schematically showing a configuration of a substrate processing apparatus to which a component of a substrate processing apparatus in accordance with the embodiment of the present invention is applied. The substrate processing apparatus is configured to perform RIE (reactive ion etching) processing or ashing processing on a semiconductor wafer W as a substrate.

As shown in FIG. 1, a substrate processing apparatus 10 has a columnar chamber 11 which has a processing space S therein. In the chamber 11, a cylindrical susceptor 12 is disposed as a mounting table on which a semiconductor wafer (hereinafter referred to as a "wafer") W having a diameter of, e.g., 300 mm is mounted. The inner wall surface of the chamber 11 is covered with a side wall member 31. The side wall member 31 is made of aluminum, a surface thereof facing the processing space S being coated with a thermally sprayed ceramic film such as yttria ($Y_2O_3$) or alumina oxide. Moreover, the chamber 11 is electrically grounded, and the susceptor 12 is installed via an insulating member 29 on the bottom of the chamber 11. Furthermore, the surface of the side wall member 31 facing the processing space S may also be coated with an oxide film such as alumite and the like.

In the substrate processing apparatus 10, a gas exhaust path 13 through which gas above the susceptor 12 is exhausted out of the chamber 11 is formed between the inner side wall of the chamber 11 and the side surface of the susceptor 12. An annular gas exhaust plate 14 that prevents downward leakage of a plasma is disposed in the gas exhaust path 13. A downstream space of the gas exhaust plate 14 in the gas exhaust path 13 communicates with a space below the susceptor 12 which communicates with an automatic pressure control valve (hereinafter referred to as "APC valve") 15, which is a variable butterfly valve. The APC valve 15 is connected via an isolator 16 to a turbo molecular pump (hereinafter referred to as "TMP") 17, which is a vacuum exhaust pump. The TMP 17 is connected via a valve V1 to a dry pump (hereinafter referred to as "DP") 18, which is also a gas exhaust pump. The APC valve 15 controls the pressure in the chamber 11, and the TMP 17 exhausts the chamber 11 to a specific vacuum level.

Moreover, bypass line 19 connects a path communicating between the isolator 16 and the APC valve 15 to the DP 18 via a valve V2. The DP 18 roughly exhausts the chamber 11 via the bypass line 19.

A radio frequency power supply 20 is connected to the susceptor 12 via a power feeding rod 21 and a matching unit 22 to supply a radio frequency power thereto. Thus, the susceptor 12 functions as a lower electrode. The matching unit 22 reduces reflection of the radio frequency power from the susceptor 12 to maximize the efficiency of the supply of the radio frequency power to the susceptor 12. The susceptor 12 applies to the processing space S the radio frequency power supplied from the radio frequency power supply 20.

A disk-shaped ESC (electrostatic chuck) electrode plate 23 formed of an electrically conductive film is provided at an upper portion of the inside of the susceptor 12. An ESC DC power supply 24 is electrically connected to the ESC electrode plate 23. A wafer W is attracted and held on the top surface of the susceptor 12 by a Johnsen-Rahbek force or a Coulomb force generated by a DC voltage applied to the ESC electrode plate 23 from the ESC DC power supply 24. Moreover, an annular focus ring 25 is provided on the upper portion of the susceptor 12 to surround the wafer W attracted and held on to the top surface of the susceptor 12. The focus ring 25 is exposed to the processing space S and focuses the plasma generated in the processing space S onto the surface of the wafer W, thereby improving the efficiency of the plasma processing.

An annular coolant reservoir 26 that extends annularly, for example, in a circumferential direction, is provided inside the susceptor 12. A coolant, for example, cooling water or a Galden (registered trademark) fluid, maintained at a predetermined temperature, is supplied to the coolant reservoir 26 via coolant line 27 from a chiller unit (not shown) to be circulated therein. The processing temperature of the wafer W attracted and held on the top surface of the susceptor 12 is controlled by the temperature of the coolant.

A plurality of heat transfer gas supply openings 28 are provided in a portion of the top surface of the susceptor 12 on which the wafer W is attracted and held (hereinafter referred to as the "attracting surface"). The heat transfer gas supply openings 28 are connected to a heat transfer gas supply unit 32 by a heat transfer gas supply line 30 provided inside the susceptor 12. The heat transfer gas supply unit 32 supplies helium (He) gas as a heat transfer gas via the heat transfer gas supply openings 28 into a gap between the attracting surface of the susceptor 12 and the rear surface of the wafer W.

In the attracting surface of the susceptor 12, a plurality of pusher pins 33 are provided as lifting pins that freely project from the top surface of the susceptor 12. The pusher pins 33 freely project from the attracting surface of the susceptor 12. When the wafer W is being attracted to and held on the attracting surface of the susceptor 12 in order to carry out plasma processing on the wafer W, the pusher pins 33 are retreated inside the susceptor 12, and when the wafer W is to be transferred out from the chamber 11 after having been subjected to the plasma processing, the pusher pins 33 project from the upper surface of the susceptor 12 so as to lift the wafer W up away from the susceptor 12.

A gas introducing shower head 34 is disposed in the ceiling portion of the substrate processing chamber 11 to face the susceptor 12. The gas introducing shower head 34 includes a ceiling electrode plate 35, a cooling plate 36 (component of a substrate processing apparatus), and an upper electrode body 37. The ceiling electrode plate 35, the cooling plate 36, and the upper electrode body 37 are piled up in this order to the upward.

The ceiling electrode plate 35 is a disk-shaped component made of a conductive material. A radio frequency (RF) power supply 38 is connected to the ceiling electrode plate 35 via a matching unit (MU) 39 to supply a radio frequency power thereto. The ceiling electrode plate 35 serves as an upper electrode. The matching unit 39 has a similar function to the matching unit (MU) 22. The ceiling electrode plate 35 applies to the processing space S the radio frequency power supplied from the radio frequency power supply 38. An annular insulating member 40 is disposed around the ceiling electrode plate 35 to surround it to thereby insulate it from the chamber 11.

The cooling plate 36 is a disk-shaped component made of aluminum, for example, a JIS A6061 alloy. The surface of the cooling plate 36 is covered with an alumite film 57 formed by employing a film forming method to be described later. The cooling plate 36 cools the ceiling electrode plate 35 by absorbing the heat of the ceiling electrode plate 35 heated to a high temperature by plasma processing. Since the bottom surface of the cooling plate 36 comes in contact with the top surface of the ceiling electrode plate 35 via the alumite film 57, the ceiling electrode plate 35 is DC-insulated from the cooling plate 36 while communicating with the cooling plate 36 through RF. Thus, the ceiling electrode 35 functions as an electrode.

The upper electrode body 37 is a disk-shaped component made of aluminum. The surface of the upper electrode body 37 is also covered with the alumite film 57 formed by employing a film formation method to be described later. The upper electrode body 37 has a buffer chamber 41 therein, and a processing gas inlet line 42 connects a processing gas supply unit (not shown) to the buffer chamber 41. A processing gas is introduced into the buffer chamber 41 via the processing gas inlet line 42.

The ceiling electrode plate 35 and the cooling plate 36 have a plurality of gas holes 43 and 44 (through holes) penetrating through the ceiling electrode plate 35 and the cooling plate 36, respectively, in the direction of the thickness thereof. The upper electrode body 37 also has a plurality of gas holes 45 penetrating through an area between the bottom surface of the upper electrode body 37 and the buffer chamber 41. When the ceiling electrode plate 35, the cooling plate 36, and the upper electrode body 37 are piled up, the corresponding gas holes 43, 44 and 45 are aligned along one line, so that the processing gas introduced into the buffer chamber 41 is supplied into the processing space S.

A loading/unloading port 46 is provided at a side wall of the chamber 11 in a position corresponding to a height of the wafer W when it is lifted up from the susceptor 12 by the pusher pins 33. A gate valve 47 for opening and closing the loading/unloading port 46 is attached to loading/unloading port 46.

In the chamber 11 of the plasma processing apparatus 10, by applying a radio frequency power into the processing space S by the susceptor 12 and the ceiling electrode plate 35 as described above, the processing gas supplied through the gas introducing shower head 34 into the processing space S is converted into a high density plasma so that ions positive and/or radicals are produced, whereby the wafer W is subjected to a plasma processing by the produced ions and/or radicals.

Figure 2:
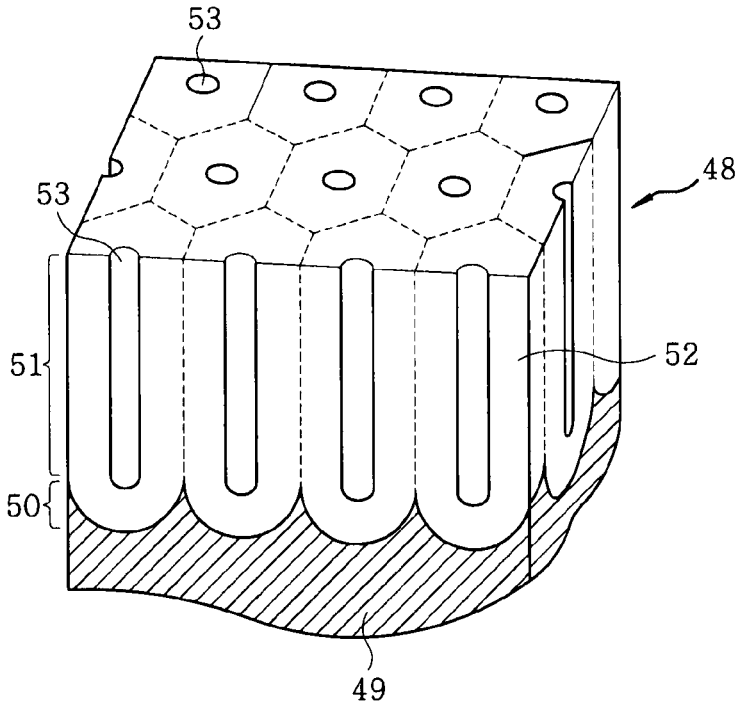
FIG. 2 is a sectional perspective view showing a configuration of a general alumite film which is formed on a surface of a component of a substrate processing apparatus.

FIG. 2 is a sectional perspective view showing a configuration of a general alumite film formed on the surface of a component of a substrate processing apparatus.

As shown in FIG. 2, an alumite film 48 includes a barrier layer 50 formed on an aluminum base 49 of the component, and a porous layer 51 formed on the barrier layer 50.

The barrier layer 50 is a layer made of aluminum oxide ($Al_2O_3$). Because the barrier layer 50 is impermeable to gas, it prevents the corrosion gas and plasma from being contacted with the aluminum base 49. The porous layer 51 has a plurality of cells 52 that are made of aluminum oxide and grow in the direction of the thickness of the alumite film 48 (hereinafter referred to merely as "film thickness direction"). Each of the cells 52 has a pore 53 that is open in the surface of the alumite film 48 and grows in the film thickness direction.

The alumite film 48 is formed by connecting the component to the anode of a DC power supply, immersing the component in an acidic solution (electrolytic solution) and oxidizing (anodic oxidizing) the surface of the aluminum base 49. Herein, the porous layer 51 together with the barrier layer 50 is formed, and in the porous layer 51, the pores 53 grow in the film thickness direction as the cells 52 grow.

Figure 3A:
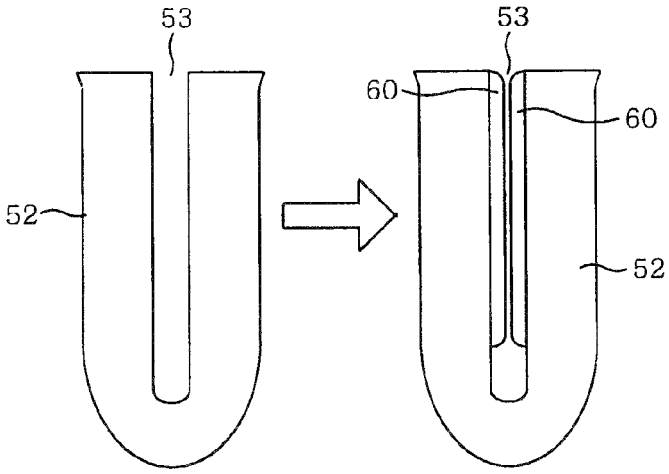
FIG. 3A Prior Art
FIGS. 3A to 3D show a pattern of growth of an alumite film in a conventional film forming method, FIG. 3A showing a pattern of expansion and growth of aluminum oxide in pores, FIG. 3B showing a growth direction of the alumite film, FIG. 3C showing a pattern of growth of crystal columns in the alumite film, and FIG. 3D showing a crack generated between crystal columns.

Further, the alumite film 48 is generally subjected to sealing treatment, and in a conventional sealing process, the alumite film 48 is exposed to a high pressure vapor of a temperature ranging from 120 to 140° C. or in boiling water of a temperature ranging in 85 to 95° C. At this time, as shown in FIG. 3A, an aluminum oxide 60 in each cell 52 expands as a result of absorbing the vapor to form hydrate, thereby roughly sealing the pores 53.

Figure 3B:
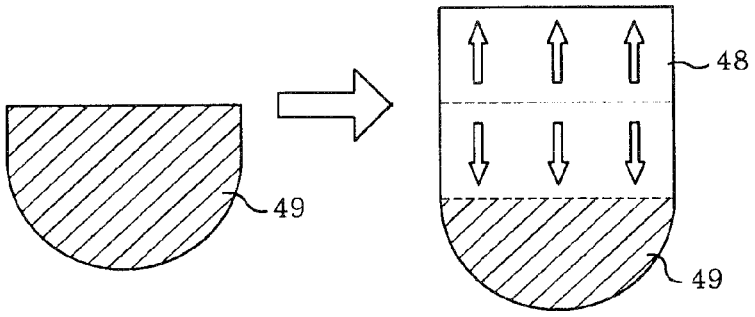
FIG. 3B Prior Art
Figure 3C:
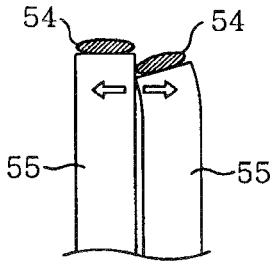
FIG. 3C Prior Art

Moreover, a sulfuric acid solution is generally used in the anodic oxidation process, and when the component is immersed in the sulfuric acid solution, as shown in FIG. 3B, the aluminum base 49 becomes oxidized, thus causing the alumite film 48 to grow inward as well as outward. In the alumite film 48 growing toward the inside of the aluminum base 49, aluminum merely turns into aluminum oxide, whereas in the alumite film 48 growing toward the outside of the aluminum base 49, as shown in FIG. 3C, crystal columns 55 of aluminum oxide having impurities 54 at the top thereof grow toward the outside of the alumite film 48. At this time, when a certain crystal column 55 grows while bending to collide with the adjacent crystal column 55, compressive stress develops in each of the crystal columns 55.

In the alumite film 48 formed by the anodic oxidation process using a sulfuric acid solution and the sealing process using a vapor, when the component is heated to a high temperature in plasma processing and the like, e.g., when the temperature of the surface of the cooling plate 36 which has the alumite film 48 formed thereon and comes in contact with the ceiling electrode plate 35 is higher than the temperature at which the alumite film is formed, the aluminum oxide 60 in the pores 53 of the alumite film 48 may expand. In this state, since there is no place for discharging the aluminum oxide 60 in the pores 53, compressive stress may develop in each of the cells 52. Moreover, thermal stress may be added to the compressive stress caused by the collision between the crystal columns 55. As a result, cracks may develop in the alumite film 48.

In contrast with this, in an alumite film formed on the surface of the cooling plate 36 which is the component of the substrate processing apparatus in accordance with the embodiment of the present invention, the development of the compressive stress in the porous layer 51 or the like in the alumite film 48 is suppressed.

Specifically, the cooling plate 36 from which an aluminum base 56 containing silicon thereon has been peeled off is connected to the anode of a DC power supply while being immersed into an acidic solution based on organic acid, e.g., oxalic acid (hereinafter referred to as oxalic acid containing solution), and the surface of the cooling plate 36 is oxidized (anodic oxidation).

Figure 4A:
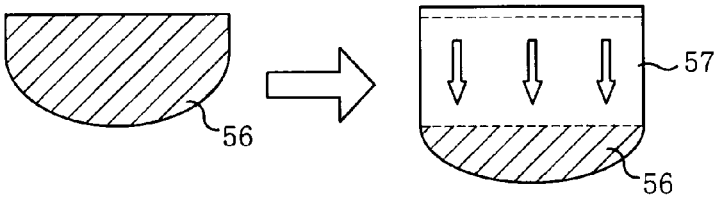
FIGS. 4A to 4C show a pattern of growth of an alumite film in accordance with the embodiment of the present invention, FIG. 4A showing a growth direction of the alumite film, FIG. 4B showing a state of pores in the alumite film, and FIG. 4C being an enlarged view of the portion "C" in FIG. 4B.
Figure 4B:
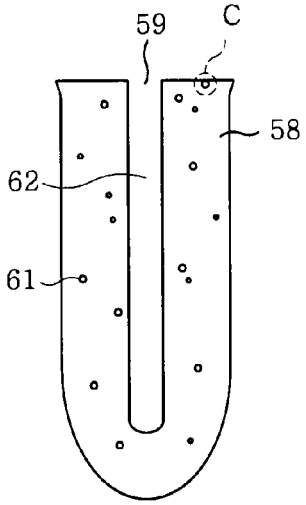

In the anodic oxidation process using an organic acid solution, as shown in FIG. 4A, the alumite film 57 grows mainly inward from the surface of the aluminum base 56, and the amount of the alumite film 57 growing outward from the surface of the aluminum base 56 is small, unlike the anodic oxidation process using a sulfuric acid solution. Accordingly, the amount of crystal columns of aluminum oxide growing outward from the surface of the aluminum base 56 is small, and the collision between the adjacent crystal columns hardly occurs. As a result, the development of compressive stress in the alumite film 57 can be suppressed. Moreover, the alumite film 57 also has a plurality of cells 58, like the alumite film 48 having the cells 52, and pores 59 like the pores 53 are also formed in the respective cells 58 (see FIG. 4B).

In addition, in the alumite film 57, the pores 59 are not sealed and, thus, an opening passage 62 is secured, whereby compressive stress in the porous layer 51 or the like is absorbed.

However, in the alumite film 57, cutting oil or hydrocarbon-based cleaning fluid for cleaning cutting oil which is used for the processing the cooling plate 36 to which the alumite film 57 is applied can infiltrate into the alumite film 57 during the processing of the cooling plate 36, as the case of the general alumite film 48. If the cutting oil or hydrocarbon-based cleaning solution infiltrates into the alumite film 57, the heat resistance of the alumite film 57 is reduced, so that cracks can develop in the alumite film 57 when the cooling plate 36 is heated to a high temperature.

To overcome such problems, the alumite film 57 of the cooling plate 36 is impregnated with ethyl silicate. If the alumite film 57 is impregnated with ethyl silicate, the silicon of ethyl silicate is dispersed into the alumite film 57 to remain there as silicon granules 61, and thus cutting oil or the like can be prevented from infiltrating into the alumite film 57. Accordingly, the generation of cracks in the alumite film 57 can be suppressed.

Figure 3D:
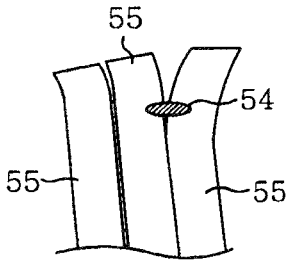
FIG. 3D Prior Art

Moreover, the aluminum base 56 of the cooling plate 36 contains silicon. In the conventional anodic oxidation process using a sulfuric acid solution, if the aluminum base 49 contains impurities 54 such as silicon, the crystal columns 55 are grown to avoid the impurities 54, and thus the structure of the alumite film 48 becomes sparse. In addition, since each of the crystal columns 55 is pressed by the impurities 54, compressive stress develops, so that cracks is generated between the crystal columns 55 (see FIG. 3D).

Figure 4C:
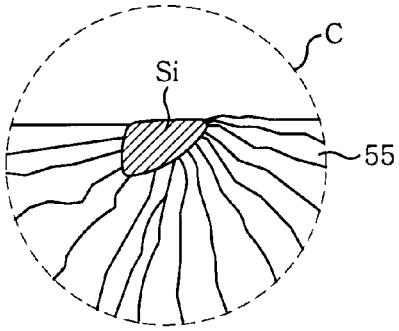

Meanwhile, in the alumite film 57 formed by performing an anodic oxidation process by using an organic acid solution on the cooling plate 36 mainly formed of a silicon-containing aluminum alloy such as an A6061 alloy, as shown in FIG. 4C, the crystal columns 55 grow radially from silicon (Si) without avoiding it, and the crystal structure of the alumite film 57 is not aligned one. Accordingly, since the compressive stress in the alumite film 57 is absorbed, the heat resistance of the alumite film 57 is improved, and thus the generation of cracks in the alumite film 57 can be further suppressed.

Moreover, the phenomenon that the crystal structure of the alumite film 57 is not aligned one has been confirmed by using an electron microscope by the present inventor. In addition, the present inventor has found that, when the amount of the silicon contained in the above-described alloy is in a range from 0.4 to 0.8 mass %, a numerous number of crystal columns 55 growing radially are generated, and the crystal structure of the alumite film 57 is not aligned one.

Accordingly, the generation of particles caused by a damage of the alumite film 57 can be reliably prevented, even when the cooling plate 36 is heated to a high temperature or comes in contact with cutting oil or the like.

Hereinafter, a film forming method in accordance with the embodiment of the present invention will be described.

Figure 5:
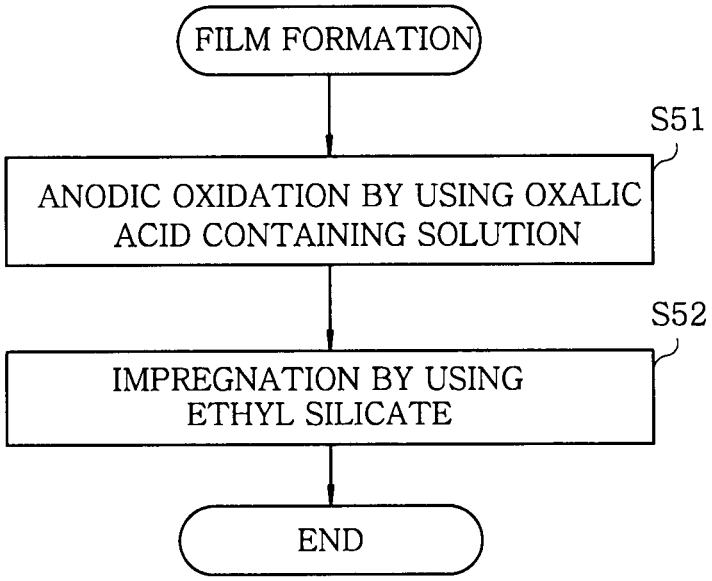
FIG. 5 is a flow chart showing a film forming method in accordance with the embodiment of the present invention.

FIG. 5 is a flowchart showing a film forming method in accordance with the embodiment of the present invention.

As shown in FIG. 5, the cooling plate 36 from which the aluminum base 56 containing silicon has been peeled off is connected to the anode of a DC power supply and immersed into an oxalic acid containing solution as an organic acid solution, and the surface of the cooling plate 36 is oxidized (step S51; anodic oxidation process). Then, the formed alumite film 57 is impregnated with ethyl silicate without sealing each pore 59 of the alumite film 57 (step S52), and the process comes to an end.

In the process shown in FIG. 5, the cooling plate 36 mainly formed of an aluminum alloy containing silicon is connected to the anode of a DC power supply and immersed in an oxalic acid containing solution, and the alumite film 57 formed on the surface of the cooling plate 36 by the immersion process is impregnated with ethyl silicate. Accordingly, the occurrence of compressive stress by the collision between crystal columns in the alumite film 57 can be suppressed. Also, the opening passage in each of the pores 59 can be secured, whereby compressive stress in the porous layer or the like does not occur. Moreover, since ethyl silicate infiltrates into the alumite film 57, cutting oil or the like can be prevented from infiltrating into the alumite film 57.

In addition, since the aluminum base 56 containing silicon is subjected to an anodic oxidation process by using an oxalic acid containing solution, the crystal structure of the alumite film 57 is not an aligned one.

Accordingly, the generation of particles due to a damage of the alumite film 57 can be prevented, even when the cooling plate 36 is heated to a high temperature or comes in contact with cutting oil or the like.

Moreover, when the cooling plate 36 is baked after being impregnated with ethyl silicate, the silicon granules 61 can be secured to remain in the alumite film 57 by drying the cooling plate 36, and thus the infiltration of cutting oil or the like into the alumite film 57 can be reliably prevented.

Further, the cooling plate 36 has the plurality of gas holes 44, but even when particles of yttria or the like are sprayed toward the surfaces of the gas holes 44 by using a gun spray or the like, there is some portion to which the particles are not sufficiently attached, because the gas holes 44 are generally narrow holes. Specifically, it is difficult to form yttria films or the like having excellent heat resistance on the surfaces of the gas holes 44 by spraying, but when the cooling plate 36 is immersed in the oxalic acid containing solution and immersed in ethyl silicate to impregnate the alumite film 57 with ethyl silicate, the oxalic acid containing solution as an electrolyte solution and ethyl silicate come in contact with the surfaces of the gas holes 44. Thus, the alumite film 57 impregnated with ethyl silicate can be formed on the surfaces of the gas holes 44. Accordingly, the generation of particles can be reliably prevented.

Furthermore, the surfaces of other components can also be formed with the alumite films 57 by immersing them in the oxalic acid containing solution and the formed alumite films 57 can be impregnated by immersing in ethyl silicate. The other components can be components having surfaces to which particles of yttria or the like are hardly or never attached by using a gun spray or the like, e.g., components having narrow holes, deep holes, and inward recess. Accordingly, the generation of particles can be reliably prevented.

Although in the process shown in FIG. 5, the alumite film 57 is formed on the surface of the cooling plate 36, a component on which the alumite film 57 is formed is not limited thereto. For example, the alumite film 57 may be formed on the surface of the upper electrode 37 in accordance with the process shown in FIG. 5 and may be applied to all members such as a deposit shield or a shutter.

Moreover, the organic acid solution which is used to oxidize the surface of the cooling plate 36 may be, for example, a mixture of the oxalic acid containing solution with any one or more selected from compounds having a carboxyl group, such as formic acid, acetic acid, propionic acid, butyric acid, valeric acid, caproic acid, caprylic acid, pelargonic acid, caprylic acid, lauric acid, myristic acid, pentadecylic acid, palmitic acid, margaric acid, stearic acid, oleic acid, linoleic acid, arachidonic acid, docosahexaenoic acid, eicosapentaenoic acid (EPA), malonic acid, succinic acid, phthalic acid, benzoic acid, isophthalic acid, terephthalic acid, salicylic acid, gallic acid, mellitic acid, cinnamic acid, pyuvic acid, lactic acid, malic acid, citric acid, fumaric acid, maleic acid, aconitic acid, glutaric acid, adipic acid, amino acid, nitrocarboxylic acid, pyromellitic acid, trimellitic acid, diglycolic acid, n-butyric acid, citraconic acid, itaconic acid, acetylenedicarbonic acid, thiomalic acid, mucic acid, tartaric acid, glyoxylic acid, or oxamidic acid.

Furthermore, the organic acid solution may be a mixture of the oxalic acid containing solution with any one or more selected from phosphoric acid, sulfuric acid, nitric acid, chromic acid, boric acid and the like.

In addition, the power supply that is used in the anodic oxidation process is not limited to a direct current power supply and may be an AC power supply or a power supply that supplies DC current superimposed by AC current. It may also be a pulse power supply.

What is claimed is:

1. A component of a substrate processing apparatus that performs plasma processing on a substrate, the component comprising:

an aluminum base mainly formed of an aluminum alloy containing silicon; and an alumite film having heat resistance to heat applied when the plasma processing is performed and including a barrier layer and a porous layer formed on the barrier layer such that the porous layer has a plurality of pores each having an opening passage, the alumite film being formed on a surface of the aluminum base by an anodic oxidation process which includes connecting the aluminum base to an anode of a power supply and immersing the aluminum base in a solution mainly formed of an organic acid, wherein the alumite film is impregnated with ethyl silicate without filling or sealing the opening passages of the plurality of pores formed in the porous layer so that the plurality of pores have opening passages which are not sealed by the ethyl silicate, and wherein silicon in the ethyl silicate is dispersed into the alumite film and remains therein as silicon granules.

2. A component of a substrate processing apparatus that performs plasma processing on a substrate, the component comprising:

an aluminum base mainly formed of an aluminum alloy containing silicon; and an alumite film having heat resistance to heat applied when the plasma processing is performed, the alumite film being disposed on a surface of the aluminum base and having oxide crystal columns oriented radially from the silicon serving as a nucleus, wherein the alumite film includes a plurality of pores each having an opening passage, wherein the alumite film is impregnated with ethyl silicate without filling or sealing the opening passages of the plurality of pores formed in the alumite film so that the plurality of pores have opening passages therein which are not sealed by the ethyl silicate, and wherein silicon in the ethyl silicate is dispersed into the alumite film and remains therein as silicon granules.

3. The component of claim 1, wherein the alumite film is not subjected to a sealing treatment.

4. The component of claim 2, wherein the alumite film is not subjected to a sealing treatment.

5. The component of claim 1, wherein an amount of the silicon contained in the alloy is in a range from 0.4 to 0.8 mass %.

6. The component of claim 2, wherein an amount of the silicon contained in the alloy is in a range from 0.4 to 0.8 mass %.

7. The component of claim 1, wherein the alloy is a JIS A6061 alloy.

8. The component of claim 2, wherein the alloy is a JIS A6061 alloy.

9. The component of claim 1, wherein the component is an upper electrode.

10. The component of claim 2, wherein the component is an upper electrode.

11. The component of claim 1, wherein the component is a disk-shaped cooling plate which has a plurality of through-holes.

12. The component of claim 2, wherein the component is a disk-shaped cooling plate which has a plurality of through-holes.

13. The component of claim 1, wherein the alumite film is subjected to baking after impregnating the alumite film with the ethyl silicate.

14. The component of claim 2, wherein the alumite film is subjected to baking after impregnating the alumite film with the ethyl silicate.

15. The component of claim 1, wherein an amount of crystal columns of aluminum oxide growing outward from the surface of the aluminum base is smaller than an amount of crystal columns of aluminum oxide growing inward from the surface of the aluminum base so that collision between adjacent crystal columns and development of compressive stress in the alumite film caused thereby is restrained.

16. The component of claim 2, wherein an amount of crystal columns of aluminum oxide growing outward from the surface of the aluminum base is smaller than an amount of crystal columns of aluminum oxide growing inward from the surface of the aluminum base so that collision between adjacent crystal columns and development of compressive stress in the alumite film caused thereby is restrained.

17. The component of claim 1, wherein the alumite film impregnated with the ethyl silicate prevents cutting oil or hydrocarbon-based cleaning fluid, which are used in a process of manufacturing the component, from infiltrating into the alumite film to thereby deteriorate the heat resistance of the alumite film, such that the alumite film impregnated with the ethyl silicate prevents cracks from developing in the alumite film and damaging the alumite film and thereby prevents generation of particles when the component is heated to a high temperature in the plasma processing.

18. The component of claim 2, wherein the alumite film impregnated with the ethyl silicate prevents cutting oil or hydrocarbon-based cleaning fluid which are used in a process of manufacturing the component from infiltrating into the alumite film to thereby deteriorate the heat resistance of the alumite film, such that the alumite film impregnated with the ethyl silicate prevents cracks from developing in the alumite film and damaging the alumite film and thereby prevents generation of particles when the component is heated to a high temperature in the plasma processing.

19. The component of claim 1, wherein the opening passages of the alumite film have a substantially constant size from a location close to a surface of the alumite film to a location close to the barrier layer.

20. The component of claim 2, wherein the opening passages of the alumite film have a substantially constant size along a length of the pores.

* * * * *